United States Patent [19]

Khare

[11] Patent Number: 4,919,735

[45] Date of Patent: Apr. 24, 1990

[54] KHARE PIPE MOLD STEEL

[75] Inventor: Ashok K. Khare, Warren, Pa.

[73] Assignee: National Forge Company, Irvine, Pa.

[21] Appl. No.: 291,509

[22] Filed: Dec. 29, 1988

[51] Int. Cl.[5] ..... C22C 38/44

[52] U.S. Cl. ..... 148/334; 148/335; 148/320; 148/909

[58] Field of Search ..... 420/10, 9, 111, 127; 148/334, 335, 320, 909; 138/177

[56] References Cited

U.S. PATENT DOCUMENTS

| | | | |
|---|---|---|---|
| 1,358,831 | 11/1920 | Cutter | 420/87 |
| 2,810,818 | 10/1957 | Rothschild et al. | 219/137 |
| 2,858,206 | 10/1958 | Boyce et al. | 148/334 |
| 2,921,849 | 1/1960 | Furgason | 420/109 |
| 3,152,652 | 10/1964 | Murray et al. | 175/15 |
| 3,162,751 | 12/1964 | Robbins | 219/137 |
| 3,496,031 | 2/1970 | Suhy | 148/6.35 |
| 3,531,279 | 9/1970 | Baerlecken | 420/108 |
| 3,726,724 | 4/1973 | Davies et al. | 148/320 |
| 3,920,051 | 11/1975 | Bell et al. | 138/155 |
| 3,976,514 | 8/1976 | Matsukura et al. | 148/12 F |
| 4,035,182 | 7/1977 | Kowaka et al. | 420/584 |
| 4,295,902 | 10/1981 | Economopoulos | 148/333 |
| 4,463,061 | 7/1984 | Otogura et al. | 428/683 |
| 4,464,209 | 8/1984 | Taira et al. | 148/320 |
| 4,527,987 | 7/1985 | Berchem | 474/152 |
| 4,772,451 | 9/1988 | Andreini et al. | 420/109 |
| 4,780,275 | 10/1988 | Grefkes et al. | 420/485 |

FOREIGN PATENT DOCUMENTS

| | | | |
|---|---|---|---|
| 51-171112 | 2/1976 | Japan | 420/127 |
| 53-80318 | 7/1978 | Japan | 420/111 |
| 53-81422 | 7/1978 | Japan | 420/111 |
| 371633 | 4/1932 | United Kingdom | 420/109 |
| 751987 | 7/1956 | United Kingdom | 420/111 |

*Primary Examiner*—Deborah Yee

*Attorney, Agent, or Firm*—Wayne M. Kennard

[57] ABSTRACT

A ferritic alloy steel with high ductility and high toughness, and a controlled microstructure for making pipe molds for centrifugally casting pipe consisting essentially of from about 0.12% to about 0.22% carbon, about 0.4% to about 0.80% manganese, about 0.025% maximum phosphorus, about 0.025% maximum sulphur, about 0.15% to about 0.40% silicon, about 0.00% to about 0.55% nickel, about 0.80% to about 1.20% chromium, about 0.15% to about 0.60% molybdenum, about 0.03% to about 0.08% vanadium, and balance essentially iron.

13 Claims, No Drawings

KHARE PIPE MOLD STEEL

TECHNICAL FIELD

The present invention relates to ferritic alloy steels used for making pipe molds. More specifically, the present invention relates to ferritic alloy steels for producing pipe molds with improved service life which are used for centrifugally casting pipe.

BACKGROUND OF THE INVENTION

Pipe molds that are used for centrifugally casting pipe generally comprise an elongated cylindrical member with a "Bell" and "Spigot" end. The "Bell" and "Spigot" are separated by a barrel section.

One of the most commonly used steels for making pipe molds for centrifugally casting pipe is the AISI 4130 grade. This steel grade according to "AISI 4130," *Alloy Digest—Data On World Wide Metals and Alloys,* November 1954, Revised March 1988, pp. 3, And Kattus, J. R., "Ferrous Alloys—4130," *Aerospace Structural Metals Handbook,* 1986 Pub., pp. 1–20 can have the chemistries set forth in Table I:

TABLE I

| Element | Alloy Digest Weight % | Aerospace Handbook Weight % |
|---|---|---|
| Carbon | 0.28–0.33 | 0.28–0.33 |
| Manganese | 0.40–0.60 | 0.40–0.60 |
| Silicon | 0.20–0.35 | 0.20–0.35 |
| Phosphorus | 0.04 max. | 0.025 max. |
| Sulphur | 0.04 max. | 0.025 max. |
| Chromium | 0.80–1.10 | 0.80–1.10 |
| Molybdenum | 0.15–0.25 | 0.15–0.25 |
| Nickel | — | 0.25 max. |
| Copper | — | 0.35 max. |
| Iron | Balance | Balance |

As is seen by reviewing Table I, conventional pipe mold steels such as the AISI 4130 grade do not contain vanadium.

Conventional thinking has been that pipe mold service life is dependent primarily on the properties of hardness and strength of the as-heat treated pipe mold, therefore, these were the only properties considered for making pipe molds with a long service life.

The element that imparts hardness and strength to pipe mold steels is carbon. Hence, pipe molds intended to have a long service life are made from steels with high carbon level. Consistent with conventional thinking, the AISI 4130 grade had high carbon in the range 0.28–0.33%.

A departure from conventional thinking was to make the carbon level directly related to pipe mold size. Table II is an example this:

TABLE II

| Pipe Mold Size | Carbon Range | Aim |
|---|---|---|
| 80 mm (3.2 in.) | 0.24–0.29% | 0.26% |
| 100 mm (4 in.) | 0.24–0.30% | 0.27% |
| 150 mm (6 in.) | 0.24–0.30% | 0.27% |
| 200 mm (8 in.) | 0.26–0.31% | 0.28% |
| 250 mm (10 in.) | 0.27–0.32% | 0.29% |
| 350–1200 mm (14–40 in.) | 0.28–0.33% | 0.30% |

The carbon gradient shown in Table II is based on pipe mold size. Small size pipe molds with high carbon have a greater likelihood of either quench cracking during heat treatment or premature failure during service. Larger size pipe molds overcome this by the mass of the pipe molds causing them to cool slower during the quenching step. However, regarding the pipe molds shown in Table II, conventional thinking is followed in that hardness and strength are the primary concerns and high carbon is maintained in the pipe mold steel for that purpose.

There can be problems in fabricating pipe molds from steel that contains high carbon if the carbon is not properly accounted for in the heat treating process. In heat treating pipe molds, the temperature of the pipe mold steel is raised from room temperature to the austenizing temperature, then the pipe mold is water quenched. The micro-structure of the pipe mold at this stage is such that the pipe mold is very hard and has a great deal of internal stresses. This quenching step is followed by a tempering step which tempers the hardness, thereby, making the pipe mold softer and alleviating many of the internal stresses. The greater the carbon level in the pipe mold steel chemistry, the greater the hardness and internal stresses. These internal stresses can result in quench cracking during pipe mold manufacture or cracking due to thermal fatigue, and distortion during pipe production.

The present invention is a departure from conventional pipe mold steels as will be explained in detail in the remainder of the specification.

SUMMARY OF THE INVENTION

The present invention is a steel for making pipe molds used for centrifugally casting pipe. The steel includes vanadium and reduced carbon. The primary properties of the steel that are considered for determining the service life of the pipe molds are ductility, toughness, and the microstructure, not hardness and strength. Pipe molds made from the steel of the present invention have substantially lower internal stresses. This makes them very stable, and combined with the other novel aspects of the present invention, result in pipe molds with improved service life.

An object of the invention is to provide a steel for producing pipe molds with improved service life for centrifugally casting pipe.

Another object of the present invention is to provide a steel for producing pipe molds with improved service life for centrifugally casting pipe, with the pipe mold steel having a reduced carbon level and vanadium.

A further object of the invention is to provide a steel for producing pipe molds with improved service life for centrifugally casting pipe in which the service life is dependent primarily on the properties of ductility and toughness, and the after-heat treatment microstructure of the steel.

These and other objects of the invention will be described more fully in the remainder of the specification.

DETAILED DESCRIPTION OF THE INVENTION

The present invention is a steel for producing pipe molds with improved service life that are used for centrifugally casting pipe. Pipe molds made from this steel can be used to centrifugally cast both large and small diameter pipe. The primary properties that are considered for determining the service life of pipe molds made from the steel of the present invention are ductility, toughness, and the after-heat treatment microstructure rather than hardness and strength. And it has been found that the combination of vanadium and reduced carbon in the ranges specified for the steel of the present invention promote the desired toughness and ductility, and the after-heat treatment microstructure. The weight percentages of the steel of the present invention are set forth in Table III:

TABLE III

| Element | Wt. % |
|---|---|
| Carbon | 0.12–0.22% |
| Manganese | 0.40–0.80% |
| Phosphorus | 0.025% max. |
| Sulphur | 0.025% max. |
| Silicon | 0.15–0.40% |
| Nickel | 0.00–0.55% |
| Chromium | 0.80–1.20% |
| Molybdenum | 0.15–0.60% |
| Vanadium | 0.03–0.08% |
| Iron | Balance |

As seen in Table III, the carbon level of the steel of the present invention is lower than the conventional AISI 4130 range of 28–33% and even lower than the 24–33% range of Table II. The carbon reduction has several beneficial effects in the steel of the present invention. Among them, and important to the present invention, are a reduction in hardness and strength coupled with an increase in toughness and ductility, and increased dimensional stability due to a uniform microstructure. These combined benefits greatly improve the service life.

Regarding microstructure stability, as background, there can be problems in heat treating steels. In the heat treatment process, pipe mold steel is raised from room temperature to the austenizing temperature. At room temperature, the pipe mold steel has the body centered cubic ("BCC") microstructure. The BCC microstructure is a cubic structure with three (3) equal sides. In this structure eight atoms are present at each of the eight corners of the cube with an additional atom present at the center of the cube. At the austenizing temperature, the steel has the face centered cubic ("FCC") microstructure. The FCC structure is a cubic structure with an atom present at each of the eight corners of the cube as well as an additional atom present at the center of each of the six faces of the cube.

After austenizing, the pipe mold is water quenched to form some martensite which has a body centered tetragonal ("BCT") microstructure. The BCT microstructure is a modified B.C.C. structure with two (2) equal sides and one (1) elongated side. The greater the carbon level in the steel, the longer the elongated side. And the longer the elongated side, the greater the internal stresses in the steel that forms the pipe mold. The tempering step reduces these stresses somewhat and likewise reduces the elongated sides by producing tempered martensite. These internal stresses can result in quench cracking during pipe mold manufacture or cracking due to thermal fatique, and distortion during pipe production.

The reduced carbon level of the steel of the present invention provides an as-quenched BCT microstructure with shorter elongated sides. The as-quenched microstructure, therefore, has less internal stresses than conventional pipe mold steels. This reduction in internal stresses in the as-quenched structure also means that there is greater stability after tempering in pipe molds made from the steel of the present invention. The end result being that the pipe molds made from the steel of the present invention will be less susceptible to quench cracking during pipe mold manufacture or cracking due to thermal fatigue, and distortion during pipe production.

Vanadium is added to the steel of the present invention to give the steel fine grain size and prevent softening during heat temper. The fine grain size working in conjunction with the low internal stresses resulting from the use of reduced carbon further enhances the stability of the steel of the present invention.

Durng heat temper, a certain degree of hardness imparted by the carbon is lost. Even though the hardness is not one of the primary properties considered for determining the service life of the pipe molds of the present invention, the hardness after heat temper in the present invention is preferably higher that what it would be in the absence of vanadium.

When hardness and strength were the primary considerations for determining the service life of pipe molds, the heat temper temperature was varied to provide a pipe mold of predetermined hardness. Usually, the heat temper temperature was between 1050°–1200° F. The specific temperature depended on the pipe mold size and the amount of carbon in the steel chemistry. Since the main considerations for the present invention are ductility, toughness, and microstructure, not hardness and strength, a heat temper temperature of approximately 1200° F. can be used for all pipe mold sizes. This 1200° F. heat temper also improves the uniformity of properties in the finished pipe molds.

The combination of reduced carbon, vanadium and the other constituent elements, along with tempering from 1200° F., bring about a unique microstructure. The microstructure thus produced comprises predominately lower bainite with some upper bainite and tempered martensite with trace amounts, if any, of ferrite. This microstructure has the characteristics of high ductility and high toughness.

The steel of the present invention is embodied in a first pipe mold steel designated "Khare I" and a second pipe mold steel "Khare II. The weight percentage range and aim chemistries of the constituent elements of the Khare I and II steel are set forth in Table IV:

TABLE IV

| | Khare I | | Khare II | |
|---|---|---|---|---|
| Element | Range | Aim | Range | Aim |
| Carbon | 0.17–0.22% | 0.20% | 0.12–0.18% | 0.15% |
| Manganese | 0.50–0.80% | 0.65% | 0.40–0.65% | 0.55% |
| Phosphorus | 0.025% max. | Low As Possible | 0.008% max. | Low as Possible |
| Sulphur | 0.025% max. | Low As Possible | 0.004% max. | Low as Possible |
| Silicon | 0.20–0.35% | 0.25% | 0.15–0.40% | 0.23% |
| Nickel | 0.50% max. | Low As Possible | 0.45–0.55% | 0.50% |
| Chromium | 0.80–1.10% | 0.95% | 1.00–1.20% | 1.10% |
| Molybdenum | 0.15–0.25% | 0.18% | 0.40–0.60% | 0.50% |
| Vanadium | 0.03–0.08% | 0.05% | 0.06–0.08% | 0.07% |
| Iron | Balance | Balance | Balance | Balance |

The Khare I and II steels include vanadium and reduced carbon, and a unique microstructure. Khare I steel is preferably for making pipe molds for centrifugally casting up to 30 in. diameter pipe; and the Khare II steel is preferably for making pipe molds for centrifugally casting pipe with diameters larger than 30 in. Even though the Khare I and II steel both contain vanadium and reduced carbon, there is a difference in the alloying of the two steels. The difference is to account for the mass effect in heat treating large mass pipe molds made from the Khare II pipe mold steel.

Pipe molds of the Khare I and II steels have been made. Experiment I sets forth the chemistry and properties of the pipe mold made from the Khare I steel. Experiment II sets forth the chemistry and properties of the pipe mold made from the Khare II steel.

EXPERIMENT I

A 10 in. pipe mold for centrifugally casting pipe was made from the Khare I pipe mold steel. The ladle chemistry for the steel is set forth in Table V:

TABLE V

| Element | Wt. % |
|---|---|
| Carbon | 0.19% |
| Manganese | 0.61% |
| Phosphorus | 0.010% |
| Sulphur | 0.004% |
| Silicon | 0.24% |
| Nickel | 0.19% |
| Chromium | 0.88% |
| Molybdenum | 0.18% |
| Vanadium | 0.05% |
| Iron | Balance |

The pipe mold made from the Khare I steel was formed in a conventional manner and was then heat treated. The pipe mold was heat treated by water quenching from 1600° F. and heat tempering from 1200° F. The as-heat treated pipe mold had a wall thickness of 1.5 in. and a weight of 4100 lbs.

The pipe mold made from the Khare I steel was tested for properties. Tables VI to XI are the results of those tests at the "Bell", "Midlength", and "Spigot" of the pipe mold. The "Bell" and "Spigot" tests were conducted on a test piece from the barrel section of the pipe mold. The test piece was approximately 8 in. long and approximately 12 in. from the start of the "Bell" contour or the "Spigot" end. Similarly, the "midlength" tests were conducted on a test piece approximately 8 in. long and located at middle of the pipe mold.

The properties at the "Bell" of the pipe mold made from the Khare I steel are set forth in Table VI and VII:

TABLE VI

Tensile Tests At The Bell

| Test Temp. °F. | T.S. ksi | 0.2% Y.S. ksi | % Elong. | % RA |
|---|---|---|---|---|
| Longitudinal Direction | | | | |
| Room Temp. (+75° F.) | 96.8 | 81.2 | 24.0 | 73.5 |
| 500 | 91.0 | 73.0 | 22.0 | 72.0 |
| 600 | 92.0 | 73.0 | 25.0 | 75.0 |
| 700 | 86.0 | 71.5 | 24.0 | 79.0 |
| 800 | 77.5 | 66.0 | 21.0 | 81.0 |
| 900 | 69.5 | 62.5 | 23.0 | 86.0 |
| 1000 | 61.5 | 58.0 | 24.0 | 88.0 |
| 1100 | 51.0 | 50.0 | 23.0 | 91.0 |
| 1200 | 37.0 | 35.0 | 24.0 | 90.0 |
| Tangential Direction | | | | |
| Room temp. (+75° F.) | 96.8 | 82.2 | 21.5 | 58.5 |

TABLE VII

Charpy-V-Notch Impact Test At The Bell

| Test Temp. °F. | Ft. lbs. | % Shear | Lat. Exp. |
|---|---|---|---|
| Longitudinal Direction | | | |
| Room Temp. (+75° F.) | 164 | 93 | 0.089 |
| +20 | 161 | 92 | 0.088 |
| Tangential Direction | | | |
| Room Temp. (+75° F.) | 83 | 79 | 0.061 |
| +20 | 49 | 49 | 0.043 |

At the "Bell", the hardness of the pipe mold at the outside diameter is Scleroscope No. 30–32 and the grain size is 7–9. The microstructure is 75% lower bainite, 10% upper bainite, 10% tempered martensite, and 5% ferrite.

The properties at the "Midlength" of the pipe mold made from the Khare I steel are set forth in Tables VIII and IX:

TABLE VIII

Tensile Tests At The Midlength

| Test Temp. °F. | T.S. ksi | 0.2% Y.S. ksi | % Elong. | % RA |
|---|---|---|---|---|
| Longitudinal Direction | | | | |
| Room Temp. (+75° F.) | 98.2 | 82.5 | 24.5 | 74.5 |
| 500 | 92.0 | 75.0 | 22.0 | 74.0 |
| 600 | 92.5 | 74.5 | 24.0 | 74.0 |
| 700 | 86.5 | 70.5 | 23.0 | 78.0 |
| 800 | 78.0 | 66.5 | 22.0 | 81.0 |
| 900 | 68.5 | 62.0 | 22.0 | 86.0 |
| 1000 | 60.5 | 57.5 | 22.0 | 90.0 |
| 1100 | 50.5 | 48.5 | 24.0 | 90.0 |
| 1200 | 38.0 | 36.0 | 25.0 | 91.0 |
| Tangential Direction | | | | |
| Room temp. (+75° F.) | 98.0 | 82.5 | 22.0 | 64.5 |

TABLE IX

Charpy-V-Notch Impact Tests At The Midlength

| Test Temp. °F. | Ft. lbs. | % Shear | Lat. Exp. |
|---|---|---|---|
| Longitudinal Direction | | | |
| Room Temp. (+75° F.) | 172 | 100 | 0.093 |
| +20 | 163 | 92 | 0.090 |
| Tangential Direction | | | |
| Room Temp. (+75° F.) | 104 | 100 | 0.076 |
| +20 | 67 | 58 | 0.049 |

At the "Midlength", the hardness of the pipe mold at the outside diameter is Scleroscope No. 29–30 and the grain size is 7–9. The microstructure 70% lower bainite, 10% upper bainite, 15% tempered martensite, and 5% ferrite.

The properties at the "Spigot" of the pipe mold made from the Khare I steel are set forth in Tables X and XI:

TABLE X

| Tensile Tests At The Spigot | | | | |
|---|---|---|---|---|
| Test Temp. °F. | T.S. ksi | 0.2% Y.S. ksi | % Elong. | % RA |
| Longitudinal Direction | | | | |
| Room Temp. (+75° F.) | 99.5 | 84.2 | 24.0 | 74.0 |
| 500 | 93.5 | 76.0 | 22.0 | 73.0 |
| 600 | 94.0 | 75.0 | 24.0 | 73.0 |
| 700 | 88.0 | 72.5 | 23.0 | 78.0 |
| 800 | 79.0 | 69.5 | 22.0 | 81.0 |
| 900 | 70.5 | 64.0 | 22.0 | 86.0 |
| 1000 | 62.5 | 60.0 | 22.0 | 87.0 |
| 1100 | 52.5 | 51.0 | 23.0 | 90.0 |
| 1200 | 38.0 | 37.0 | 25.0 | 92.0 |
| Tangential Direction | | | | |
| Room temp. (+75° F.) | 99.5 | 84.0 | 22.0 | 62.5 |

TABLE XI

| Charpy-V-Notch Impact Tests AT The Spigot | | | |
|---|---|---|---|
| Test Temp. °F. | Ft. lbs. | % Shear | Lat. Exp. |
| Longitudinal Direction | | | |
| Room Temp. (+75° F.) | 165 | 100 | 0.091 |
| +20 | 160 | 92 | 0.090 |
| Tangential Direction | | | |
| Room Temp. (+75° F.) | 97 | 100 | 0.071 |
| +20 | 71 | 65 | 0.051 |

At the "Spigot", the hardness of the pipe mold at the outside diameter is Scleroscope No. 30–31 and the grain size is 7–9. The microstructure is 70% lower bainite, 10% upper bainite, 15% tempered martensite, and 5% ferrite.

EXPERIMENT II

A 36 in. pipe mold for centrifugally casting pipe was made from the Khare II pipe mold steel. The ladle chemistry for the steel is set forth in Table XII:

TABLE XII

| Element | Wt. % |
|---|---|
| Carbon | 0.13% |
| Manganese | 0.49% |
| Phosphorus | 0.008% |
| Sulphur | 0.004% |
| Silicon | 0.20% |
| Nickel | 0.52% |
| Chromium | 1.06% |
| Molybdenum | 0.51% |
| Vanadium | 0.06% |
| Iron | Balance |

The pipe mold made from the Khare II steel was formed in a conventional manner and was then heat treated. The pipe mold was heat treated by normalizing from 1700° F., water quenching from 1600° F. and heat tempering from 1200° F. The as-heat treated pipe mold had a wall thickness of 3.25 in. and a weight of 33,825 lbs.

The pipe mold made from the Khare II steel was tested for properties. The tensile and impact tests were conducted on an 8 in. long extension from the spigot end. These tests were only in the longitudinal direction. Tables XIII and XIV are the results of the tests:

TABLE XIII

| Tensile Tests | | | | |
|---|---|---|---|---|
| Test Temp. °F. | T.S. ksi | 0.2% Y.S. ksi | % Elong. | % RA |
| Room Temp. (+75° F.) | 112.0 | 99.5 | 21.0 | 67.0 |
| Room Temp. (+75° F.) | 109.0 | 96.0 | 21.0 | 67.0 |
| 500 | 102.0 | 85.5 | 20.0 | 61.0 |
| 600 | 102.0 | 87.0 | 20.0 | 64.0 |
| 700 | 98.5 | 85.0 | 20.0 | 66.0 |
| 800 | 90.5 | 78.0 | 19.0 | 69.0 |
| 900 | 84.5 | 75.5 | 19.0 | 74.0 |
| 1000 | 77.5 | 71.0 | 19.0 | 76.0 |
| 1100 | 67.0 | 64.5 | 18.0 | 79.0 |
| 1200 | 55.0 | 52.5 | 21.0 | 86.0 |

TABLE XIV

| Charpy-V-Notch Impact Tests | | | |
|---|---|---|---|
| Test Temp. °F. | Ft. lbs. | % Shear | Lat. Exp. |
| +75 | 66 | 56 | 0.053 |
| +75 | 108 | 76 | 0.075 |
| +75 | 64 | 54 | 0.050 |
| +20 | 36 | 22 | 0.024 |
| +20 | 67 | 29 | 0.047 |
| +20 | 12 | 10 | 0.009 |

The hardness of the pipe mold at the outside diameter is Scleroscope No. 31–34 and the grain size is 7–8. The microstructure is 75% bainite, 5% upper bainite, and 20% tempered martensite.

The terms and expressions that are used herein are terms of expression and not of limitation. And, there is no intention in the use of such terms and expressions of excluding the equivalents of the features shown and described, or portions thereof, it being recognized that various modifications are possible in the scope of the invention.

What is claimed is:

1. A pipe mold for centrifugally casting pipe formed from a ferritic alloy in weight percentage consisting essentially of from about 0.12% to about 0.22% carbon, about 0.40% to about 0.80% manganese, about 0.025% maximum phosphorus, about 0.025% maximum sulphur, about 0.15% to about 0.40% silicon, about 0.00% to about 0.55% nickel, about 0.80% to about 1.20% chromium, about 0.15% to about 0.60% molybdenum, about 0.03% to about 0.08% vanadium, and balance essentially iron.

2. The pipe mold as recited in claim 1, consisting essentially of from about 0.17% to about 0.22% carbon, about 0.50% to about 0.80% manganese, about 0.025% maximum phosphorus, about 0.025% maximum sulphur, about 0.20% to about 0.35% silicon, about 0.50% maximum nickel, about 0.80% to about 1.10% chromium, about 0.15% to about 0.25% molybdenum, about 0.03% to about 0.08% vanadium, and balance essentially iron.

3. The pipe mold as recited in claim 2, consisting essentially of about 0.20% carbon, about 0.65% manganese, about 0.025% maximum phosphorus, about 0.25% maximum sulphur, about 0.25% silicon, about 0.50% maximum nickel, about 0.95% chromium, about 0.18% molybdenum, about 0.05% vanadium, and balance essentially iron.

4. The pipe mold as recited in claim 1, consisting essentially of from about 0.12% to about 0.18% carbon, about 0.40% to about 0.65% manganese, about 0.008% maximum phosphorus, about 0.004% maximum sulphur, about 0.15% to about 0.40% silicon, about 0.45% to about 0.55% nickel, about 1.00% to about 1.20% chromium, about 0.40% to about 0.60% molybdenum, about 0.06% to about 0.08% vanadium, and balance essentially iron.

5. The pipe mold as recited in claim 4, consisting essentially of about 0.15% carbon, about 0.55% manganese, about 0.008% maximum phosphorus, about 0.004% maximum sulphur, about 0.23% silicon, about 0.50% nickel, about 1.10% chromium, about 0.50% molybdenum, about 0.07% vanadium, and balance essentially iron.

6. A pipe mold for centrifugally casting pipe being formed from a ferritic alloy which includes about 0.12% to about 0.22% carbon, about 0.03% to about 0.08% vanadium, and about 0.80% to about 1.20% chromium, with the alloy having about 67% to about 74.5% reduction of area and toughness of about 64 to about 172 ft.lbs. Charpy-V-Notch impact.

7. The pipe mold as recited in claim 6, wherein the ferritic alloy further in weight percentage consisting essentially of, in weight percentage, about 0.40% to about 0.80% manganese, about 0.025% maximum phosphorus, about 0.025% maximum sulphur, about 0.15% to about 0.40% silicon, about 0.00% to about 0.55% nickel, about 0.80% to about 1.20% chromium, about 0.15% to about 0.60% molybdenum, and balance essentially iron.

8. The pipe mold as recited in claim 7, consisting essentially of from about 0.17% to about 0.22% carbon, about 0.50% to about 0.80% manganese, about 0.025% maximum phosphorus, about 0.025% maximum sulphur, about 0.20% to about 0.35% silicon, about 0.50% maximum nickel, about 0.80% to about 1.10% chromium, about 0.15% to about 0.25% molybdenum, about 0.03% to about 0.08% vanadium, and balance essentially iron.

9. The pipe mold as recited in claim 8, consisting essentially of about 0.20% carbon, about 0.65% manganese, about 0.025% maximum phosphorus, about 0.025% maximum sulphur, about 0.25% silicon, about 0.50% maximum nickel, about 0.95% chromium, about 0.18% molybdenum, about 0.05% vanadium, and balance essentially iron.

10. The pipe mold as recited in claim 7, consisting essentially of from about 0.12% to about 0.18% carbon, about 0.40% to about 0.65% manganese, about 0.008% maximum phosphorus, about 0.004% maximum sulphur, about 0.15% to about 0.40% silicon, about 0.45% to about 0.55% nickel, about 1.00% to about 1.20% chromium, about 0.40% to about 0.60% molybdenum, about 0.06% to about 0.08% vanadium, and balance essentially iron.

11. The pipe mold as recited in claim 10, consisting essentially of about 0.15% carbon, about 0.55% manganese, about 0.008% maximum phosphorus, about 0.004% maximum sulphur, about 0.23% silicon, about 0.50% maximum nickel, about 1.10% chromium, about 0.50% molybdenum, about 0.07% vanadium, and balance essentially iron.

12. A pipe mold for centrifugally casting pipe being formed from a ferritic alloy which includes about 0.12% to about 0.22% carbon, about 0.03% to about 0.08% vanadium, and about 0.80% to about 1.20% chromium, with the microstructure substantially comprising lower bainite, lesser amounts of upper bainite and tempered martensite, and trace ferrite.

13. The pipe mold as recited in claim 12 wherein, the microstructure comprises from about 70% to about 75% lower bainite, about 5% to about 10% upper bainite, about 10% to about 20% tempered martensite, and about 0% to about 5% ferrite.

* * * * *

UNITED STATES PATENT AND TRADEMARK OFFICE

CERTIFICATE OF CORRECTION

PATENT NO. : 4,919,735

DATED : April 24, 1990

INVENTOR(S) : Ashok K. Khare

It is certified that error appears in the above-identified patent and that said Letters Patent is hereby corrected as shown below:

Col. 10, line 34, "12" should be --1, 6 or 12--

Signed and Sealed this

Seventh Day of May, 1991

*Attest:*

HARRY F. MANBECK, JR.

*Attesting Officer*

*Commissioner of Patents and Trademarks*